United States Patent [19]

Takeuchi et al.

[11] Patent Number: 4,714,528

[45] Date of Patent: Dec. 22, 1987

[54] PROCESS FOR PRODUCING ALUMINUM SUPPORT FOR LITHOGRAPHIC PRINTING PLATE

[75] Inventors: Makoto Takeuchi; Etsuo Kitazumi; Hirokazu Sakaki; Yoshio Okishi, all of Shizuoka, Japan

[73] Assignee: Fuji Photo Film Co., Ltd., Minami-ashigara, Japan

[21] Appl. No.: 886,625

[22] Filed: Jul. 18, 1986

[30] Foreign Application Priority Data

Jul. 26, 1985 [JP] Japan ..... 60-165545

[51] Int. Cl.[4] ..... C25F 3/04; B24C 1/08; C23F 1/02

[52] U.S. Cl. ..... 204/33; 204/38.3; 204/129.1; 204/129.4; 204/129.46; 204/129.75; 51/321; 51/323; 156/645; 156/665; 156/905

[58] Field of Search ..... 156/645, 665, 905; 51/321, 323, 5 R; 204/129.35, 129.46, 33, 129.1, 129.75, 129.4, 38.3

[56] References Cited

U.S. PATENT DOCUMENTS

| | | | |
|---|---|---|---|
| 4,324,841 | 4/1982 | Huang | 156/665 X |
| 4,476,006 | 10/1984 | Ohba et al. | 204/17 |
| 4,561,944 | 12/1985 | Sasaki et al. | 204/129.35 X |

FOREIGN PATENT DOCUMENTS

| | | | |
|---|---|---|---|
| 0131926 | 1/1985 | European Pat. Off. . | |
| 1033781 | 7/1958 | Fed. Rep. of Germany | 204/129.35 |
| 0046136 | 4/1979 | Japan | 156/665 |
| 625834 | 7/1949 | United Kingdom | 156/665 |
| 165625 | 4/1963 | U.S.S.R. | 204/129.35 |

*Primary Examiner*—Donald R. Valentine

*Attorney, Agent, or Firm*—Burns, Doane, Swecker & Mathis

[57] ABSTRACT

A process for producing an aluminum support for a lithographic printing plate, which comprises roughening an aluminum plate surface by a liquid honing process to form a first grain thereon and then modifying the first grain by a brush grinding process, and optionally, subjecting the modified surface to electrochemical graining. A printing plate using the aluminum support is excellent in printing durability and gives little background contamination.

16 Claims, No Drawings

PROCESS FOR PRODUCING ALUMINUM SUPPORT FOR LITHOGRAPHIC PRINTING PLATE

FIELD OF THE INVENTION

The present invention relates to a process for producing a support for a lithographic printing plate and, particularly, to a process for roughening a surface of an aluminum plate used as a support.

BACKGROUND OF THE INVENTION

Hitherto, as lithographic printing plates, so-called Presensitized Plates have been used, wherein a light-sensitive composition is applied onto an aluminum plate to form a light-sensitive layer. In the above-described aluminum plate, a rough surface is formed by a process suitably selected from a mechanical roughening process such as ball graining, wire graining, brush graining, liquid honing, etc., an electrochemical roughening process such as electrolytic graining, etc., a chemical roughening process and a combination of two or more of them, by which a satin finish is obtained on the surface. Then, it is etched, if necessary, with an aqueous solution of acid or alkali and subjected to anodic oxidation treatment. Thereafter, it is subjected, if necessary, to a treatment for providing a hydrophilic property to produce a support for a lithographic printing plate. On the treated surface, a light-sensitive layer is provided to produce the presensitized plate. This presensitized plate is then subjected to exposure to light, development, retouching, gumming-up, etc. to produce a printing plate, which is then placed on a printing apparatus to carry out printing.

Although there are many processes for treating the surface of an aluminum plate, known processes have various faults. For instance, in the case of ball graining, there are problems in that high skills are required for selection of the kind (material) or the size of balls, control of water in carrying out abrasion, determination of abrasion time and evaluation of the finished surface due to a batch processing, and productivity is very inferior. In the case of wire graining, the roughness of the resulting surface of the aluminum plate is non-uniform. In case of brush graining, high roughness is not obtained on the treated surface, and scattering is easily formed on the coarse face by the wear of the abrasion brush used. Further, there are problems that the surface of aluminum is scratched by the strong friction between the brush and the abrasive so as to form many sharp projections like molding projections, by which the light-sensitive layer to be removed by development of the presensitized plate remains to cause stains on the plate face, or scratches are easily formed on the surface by rubbing of the treated surface (rough surface) in the case of handling the aluminum plate. In the case of liquid honing, since a slurry liquid containing a fine abrasive powder dispersed in the liquid is sprayed at a high rate by compressed air, the fine abrasive powder easily sticks to the surface of aluminum, to thereby form projections; further in this process, there are problems in that the roughness of the surface cannot be sufficiently increased because the impulsive force of the slurry liquid against the surface of aluminum is small and that the setting nozzle wears significantly because the slurry liquid is jetted at a high rate. In the case of electrochemical roughening, it is necessary to carry out minute control of the electrolysis condition in order to keep the treated surface at a constant roughness, and the consumption of electric power is rather large; moreover, disposal of waste liquor containing Al ions accumulated in the electrolyte requires great expense. In the case of chemical roughening, the time required for treatment is relatively long and, consequently, it is not suitable for mass production. Further, great expense is required for disposal of waste liquor as in the case of the electrochemical process.

In order to attempt to overcome some of the above-described disadvantages associated with each graining process, an improved process comprising a combination of the brush graining or wire graining and the electrolytic graining has been proposed, as disclosed in U.S. Pat. No. 2,344,510 and Japanese Patent Application (OPI) No. 123204/78 (the term "OPI" as used herein refers to a "published unexamined patent application"), and British Pat. Nos. 1,582,620 and 2,047,274. Further, an improved process comprising a combination of the liquid honing and the electrolytic graining is disclosed in European Patent Application (OPI) No. 131926. According to such combined process, however, when the brush graining is adopted as a first step, i.e., a mechanical graining step, stains are apt to be formed in the non-image areas during printing, and when the wire graining is adopted as the first step, the printing plate has poor printing durability.

When the liquid honing is adopted as a first step, stains are not so much formed in the non-image areas during printing, but the printing plate is poor in printing durability. Thus, there is need to further improve the quality of a printing plate so as to meet the desire for better printing plates.

SUMMARY OF THE INVENTION

Accordingly, an object of this invention is to provide a process for roughening a surface of an aluminum sheet so as to have a uniform roughness suitable for lithographic printing plates.

Another object of this invention is to provide a process for producing a support for printing plates excellent in printing durability and free from stains.

Still another object of this invention is to provide a process for stably producing a support having a uniform roughness for lithographic printing plates, which process is suitable for mass production.

The present inventors have noted differences in performance of lithographic printing plates depending on the mechanical roughening process employed in the above-described combined roughening processes. As a result of intensive studies, it has now been found that a support having excellent performance characteristics can be obtained by using a particular combination of a liquid honing step for a first mechanical graining and a brush graining to modify the surface grained by the first liquid honing step, and that when the support thus prepared is further subjected to a subsequent electrochemical graining, a support having far more excellent performance characteristics can be obtained.

The term "liquid honing" used herein refers to a process as disclosed in Japanese Patent Application (OPI) No. 18390/1985 and European Patent Application (OPI) No. 127091, in which a high-pressure liquid stream jetted through a nozzle at a high rate is combined with a slurry containing fine abrasive powder jetted through another nozzle to form a combined stream which is struck against the aluminum surface to thereby roughen it.

The present invention is characterized in that an aluminum plate is first roughened by the aforesaid liquid honing to form a first grain and subsequently roughened by the brush graining to form a second grain of short cycle on the first grain, and optionally, electrochemically roughened in an electrolyte containing hydrochloric acid, nitric acid or a mixture thereof to form a third grain of shorter cycle on the second grain. The aluminum plate thus multiply roughened has increased surface area and it is a very useful support from which a lithographic printing plate having excellent printing durability and water-keeping property can be obtained.

DETAILED DESCRIPTION OF THE INVENTION

Aluminum sheets which can mainly be used in the present invention as a raw material for the support include a pure aluminum sheet and an aluminum alloy sheet. The aluminum alloy may be composed of aluminum as a main component and small amounts of silicon, iron, copper, zinc, manganese, magnesium, chromium, lead, bismuth, calcium, indium, gallium, nickel, etc. In any case, the aluminum preferably has a purity of 99% by weight or more.

Roughening of a surface of an aluminum sheet is now explained, however, the present invention can also be applied to other metal webs such as zinc, iron, etc.

Generally, aluminum sheets of rectangular shape are used as a support for lithographic printing plate in light of the structure of a printing machine. In the present invention, however, aluminum web is treated as it is until it is cut into pieces of rectangular shape, especially in the scale of mass-production.

The thickness of the aluminum sheet is properly selected in the range of from 0.1 to 0.5 mm according to tensile strength, resistance, elongation, bending strength, etc., required for the particular application of the lithographic printing plate to a printing machine.

A particularly preferred method of liquid honing comprises jetting a high-pressure liquid at a high flow rate from a nozzle, joining the stream of the high-pressure liquid with a slurry containing a fine powder of an abrasive jetted from a spout, and directing the joined stream to strike against a surface of the aluminum sheet.

An apparatus for carrying out the above-described method of liquid honing comprises at least one nozzle connected to a feeder of the high-pressure liquid and a spout connected to a feeder of the abrasive slurry, wherein the nozzle and the spout are arranged so that the slurry spouted from the latter is joined with the stream of the high-pressure liquid jetted from the former. In case of using plural nozzles for jetting the high-pressure liquid, they may be provided around the spout for the abrasive slurry.

The feeder for the high-pressure liquid has various embodiments including, for example, a container containing a liquid kept at a high liquid pressure or a system composed of a container containing a liquid at an atmospheric pressure and a pressure spouting pump connected to the container. In any embodiment, it is preferred that the liquid be jetted from the nozzle (s) at a flow rate of 30 to 140 m/second, and more preferably 70 to 120 m/second. The liquid pressure for attaining such a flow rate is from 5 to 100 kg/cm$^2$, and preferably from 30 to 50 kg/cm$^2$.

On the other hand, the feeder for the abrasive slurry comprises a container for the slurry, and, desirably, a means for stirring the slurry to prevent precipitation of solids. The means for stirring to prevent percipitation of solids may be a propeller stirrer inserted in the container or may be a system of circulating the slurry. By constantly moving the slurry, the solids in the slurry can be prevented from precipitating. The container is connected to the spout via a tube, e.g., a pressure-resisting hose, and a pump for spouting the slurry is provided in the middle of the connecting tube. The feeder for the abrasive slurry having the above-described construction feeds the slurry in a stirred state to the spout through the connecting tube by means of the pump thereby to spout the abrasive slurry from the spout. It is preferred that the spouting rate of the slurry be from 2 to 25 m/second.

The slurry comprises water and a fine powder of an abrasive. The fine powder abrasive is used at a concentration of from about 5 to about 80% by weight, and preferably from 30 to 50% by weight, in the slurry. The slurry may contain an acid or alkali if desired. Useful abrasives include diamond, quartz, flint, granite, alundum, silica, diatomaceous earth, sand, emery, garnet, talc, pumice, corundum, dolomite, magnesium oxide, alumina, zirconia, SUS, iron powder, tungsten carbide etc. These abrasives are used in a desired particle size, e.g., #20 to #4,000, preferably #20 to #600, more preferably #150 to #360, which are the mean value according to JIS Z8801-1956.

In the present invention, the stream of the slurry is accelerated by the stream of the high-pressure liquid to strike against the surface of the aluminum sheet. The angle of the striking stream against the aluminum sheet preferably ranges from about 15° to about 165°, preferably 30° to 90°.

The aluminum sheet having the first grain is subsequently subjected to brush graining to thereby form a second grain thereon.

The brush graining is preferably conducted according to the method disclosed in Japanese Patent Publication No. 40047/1975 (which corresponds to U.S. patent application Ser. No. 284,851 filed Aug. 30, 1972, now abandoned) to obtain uniformly roughened surface.

Brush rolls used in the brush graining are those in which brushing materials such as nylon fiber, polypropylene fiber, animal hair, steel wire, etc. having uniform length are planted in the base portion thereof in uniform distribution.

The brushing materials preferably have a diameter of 0.1 mm to 1.5 mm and a length of 10 mm to 150 mm after they are planted.

The number of revolution of the brush rolls is selected preferably in the range of 200 rpm to 2,000 rpm. Supporting rolls used are rubber rolls or those having metal surface and good straightness.

The abrasive slurry is spread through a spray, etc. onto an aluminum sheet carried before the sheet passes the brushing rolls. The brushing rolls are pressed against the aluminum sheet so that the sheet surface is roughened between the supporting rolls and the brushing rolls under constant pressure.

The surface of the aluminum sheet having the thusly formed first and second grain has a center-line average roughness (Ra) of from about 0.3 to about 1.2 μm, and preferably from 0.35 to 0.8 μm.

The aluminum sheet having the grained surface is then subjected to alkali etching, if desired. When it is necessary to uniformly conduct the subsequent electrochemical graining hereinafter described, this etching treatment is always required. The etching treatment may also be carried out using a solution which etches aluminum, for example, an acid, e.g., fluoric acid, phosphoric acid, sulfuric acid, etc. Preferred alkalis which can be used for the etching treatment include sodium hydroxide, potassium hydroxide, sodium metasilicate, sodium carbonate, sodium aluminate, sodium gluconate, etc. The etching is preferably carried out at a temperature of from normal temperature to 90° C. for a period of from 5 seconds to 5 minutes with an etching solution having a concentration of 1 to 50% by weight until 0.1 to 10 g/m$^2$ of aluminum is etched.

Since the thus alkali-etched aluminum surface contains unetched, alkali-insoluble substances (smut), the aluminum plate should be desmutted in an acidic solution, e.g., an aqueous solution of nitric acid, sulfuric acid or phosphoric acid.

Subsequently, the surface of the aluminum plate is roughened by electrochemical graining. The electrochemical graining is carried out by electrolysis in an electrolyte comprising a 0.1 to 10 wt%, and preferably 0.3 to 3 wt%, hydrochloric acid or nitric acid solution or a mixture thereof using a direct or alternating current power source, thereby to form a third grain on the aluminum sheet. The third grain has a pit depth of from 0.1 to 1$\mu$, and preferably from 0.1 to 0.8$\mu$, and a pit diameter of from 0.1 to 5$\mu$, and preferably 0.1 to 3$\mu$.

Formation of such pit diameter is advantageously effected by using special alternating current having specific waves as described in U.S. Pat. No. 4,087,341, in which the second grain can be economically and uniformly formed by controlling the electrolytic waves. Further, the electrolyte may contain amines, gluconic acid, boric acid, phosphoric acid, fluoric acid, etc., as described in U.S. Pat. Nos. 3,963,564, 3,980,539, etc.

It is preferable that the aluminum sheet having the third grain thus formed is subsequently treated with an acid or alkali solution. Specific examples of useful acids include sulfuric acid as described in Japanese Patent Publication No. 11316/1981, phosphoric acid and a mixture of phosphoric acid and chromic acid. On the other hand, the alkali treatment comprises lightly etching the surface with an alkaline solution, such as an aqueous sodium hydroxide solution as described in Japanese Patent Publication No. 28123/1973 and British Patent No. 2,060,923, to remove smut that may be stuck to the surface. In case of the alkali treatment, since the alkali-insoluble matter remains on the etched surface, the aluminum sheet should be subjected to desmutting with an acid solution, e.g., sulfuric acid, phosphoric acid, chromic acid, etc.

The aluminum sheet on which the first grain was formed by the liquid honing and then the second grain was formed by the brush graining may be used as a support for lithographic printing plates without further treatment. However, on an intermediate layer or the aluminum sheet thus treated, an anodic oxidation film may be formed so as to improve storage stability of a diazo compound used in a light-sensitive layer, adhesion property to the light-sensitive layer and printing durability. The anodic oxidation film may also be formed on the support on which an electrochemical grain has been formed.

The term "intermediate layer" used herein refers to a silicate layer obtained by dipping the support in an aqueous solution of alkali metal silicate such as sodium silicate, as disclosed in U.S. Pat. Nos. 2,714,066 and 3,181,461 or a hydrophilic undercoat layer such as a layer of carboxymethyl cellulose, polyvinyl alcohol, etc. Examples of an electrolyte used for forming an anodic oxidation film include a solution containing phosphoric acid, chromic acid, oxalic acid, benzenesulfonic acid or the like in addition to a solution containing sulfuric acid.

An anodic oxidation film is preferably formed in a thickness of from 0.1 to 10 g/m$^2$, and more preferably from 0.3 to 5 g/m$^2$. It is preferred that alkali etching and desmutting are carried out prior to an anodic oxidation. The conditions for anodic oxidation are not particularly limited, varying depending on the type of the electrolytic solution used, but it is generally preferred to use the conditions of a concentration of the electrolytic solution of from 1 to 80% by weight, a liquid temperature of from 5° to 70° C., a current density of from 0.5 to 60 A/dm$^2$, an electric voltage of from 1 to 100 v, and an electrolysis time of from 10 seconds to 5 minutes.

The aluminum plate having roughened surface with an anodic oxidation film itself has an excellent hydrophilicity and can be provided thereon with a light-sensitive coating, and if desired, it may further be subjected to surface treatment. For instance, it may be provided with a silicate layer using an alkali metal silicate, or an undercoat layer of hydrophilic high molecular compound as described earlier. The undercoat layer is preferably provided in an amount of 5 to 150 mg/m$^2$.

Onto the aluminum support according to the present invention, a conventionally known light-sensitive layer is formed to obtain a presensitized plate, which is then imagewise exposed to light and developed to produce a lithographic printing plate having excellent performance.

Compositions used for the above-described light-sensitive layer include the following examples:

(1) A light-sensitive composition comprising a diazo resin and a binder.

Preferred examples of the diazo resin are those described in U.S. Pat. Nos. 2,063,631 and 2,667,415, Japanese Patent Publication Nos. 48001/74, 45322/74 and 45323/74 and British Patent No. 1,312,925. Preferred examples of the binder are those described in British Patent Nos. 1,350,521 and 1,460,978 and U.S. Pat. Nos. 4,123,276, 3,751,257 and 3,660,097.

(2) A light-sensitive composition comprising an o-quinonediazide compound.

Preferred o-quinonediazide compounds are o-naphthoquinonediazide compounds as described, for example, in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709, and 3,647,443, as well as many other disclosures in the literature. (3) A light-sensitive composition comprising an azide compound and a high molecular binder, including a composition comprising an azide compound and a water-soluble or alkalisoluble high molecular compound as described in British Patents Nos. 1,235,281 and 1,495,861 and Japanese Patent Application (OPI) Nos. 32331/76 and 36128/76, and a composition comprising a polymer containing an azido group and a high molecular binder as described in Japanese Patent Application (OPI) Nos. 5102/75, 84302/75, 84303/75 and 12984/78.

(4) Other light-sensitive resin compositions, including polyester compounds described in Japanese Patent Application (OPI) No. 96696/77, polyvinyl cinnamate type resins as described in British Patents Nos. 1,112,277, 1,313,390, 1,341,004 and 1,377,747, and photopolymerizable photopolymer compositions as described in U.S. Pat. Nos. 4,072,528 and 4,072,527.

These light-sensitive compositions can appropriately contain various additives, such as sensitizers to increase sensitivity, e.g., cyclic acid anhydrides; dyes as developing-out agents for visualizing the exposed images immediately after the exposure to light, thickeners for image areas, coloring agents for coloring a printing plate surface, and the like.

The above-described components are properly blended and dissolved in an organic solvent to prepare a coating composition. A concentration of the coating composition is from 2 to 50% by weight on a solid base. The coating composition is then applied to the above-described aluminum support according to a coating method selected from a roll coating method, a reverse roll coating method, a gravure coating method, an air knife coating method, etc. The amount of the composition to be coated is typically from about 0.1 to 7.0 g/m$^2$, and preferably 0.5 to 4.0 g/m$^2$, on the sheet. After coating, the composition is dried, and, if desired, cut into appropriately sized pieces.

The printing plate precursor thus produced is imagewise exposed to light and developed with a developer, for example, by immersing the plate in a developer bath or spraying the plate with a developer. The developer to be used is specific to each coating composition and can be selected from the specific examples given in the above-enumerated references correspondingly to each composition. For example, for a light-sensitive layer comprising a diazo compound and an organic high molecular binder, aqueous alkaline developers described in U.S. Pat. Nos. 3,475,171, 3,669,660, 4,186,006, etc., are used.

The light-sensitive compositions include positive working compositions in which exposed areas are removed by development processing, and negative working compositions in which non-exposed areas are removed by development processing, and the type of composition to be used is determined according to the particular purpose of the printing or working details.

After the development processing, the resulting printing plate may be subjected to additional following-up treatments, if desired. Such treatments include application of desensitizing gum as disclosed in U.S. Pat Nos. 4,253,999, 4,268,613 and 4,348,954 and burning-in treatment as disclosed in U.S. Pat. Nos. 4,191,570, 4,294,910 and 4,355,096.

The present invention will now be illustrated in greater detail with reference to examples, but it should be understood that the present invention is not limited thereto. In these examples, all percentages are by weight unless otherwise indicated.

EXAMPLE 1

(1) An aluminum web (JIS 1050, 300 mm in width) was continuously carried and roughened using a series of nozzles spaced at intervals of 35 mm. A slurry (40% by volume) containing water and alumina (#150) was combined with a water stream jetted from the nozzles at a pressure of 30 kg/cm$^2$and the combined stream was directed to strike against the aluminum surface at an angle of 45$\mu$ to roughen it.

Then, a combined stream of the above-mentioned slurry with a water stream at a pressure of 40 kg/cm$^2$was directed to strike against the aluminum surface at an angle of 135$\mu$ to further roughen it. The support thus prepared had a centerline average roughness of 0.5$\mu$.

Then, the support was soaked in an aqueous No. 3 sodium silicate solution (2.5%) at 70° C. for 20 seconds to prepare Support (I) (Comparison 1).

(2) The aluminum web (JIS 1050, 300 mm in width) was continuously carried and roughened using brushing rolls of metal rolls (340 mm in diameter and 400 mm in width) in which nylon brushes of 0.48 mm in diameter and 46 mm in height had uniformly been planted. The brushing rolls were set so that they were revolved by motor drive and went up and down by an elevator.

Three brushing rolls were used. A front and back rolls were revolved in the same direction as that of aluminum web carried and a middle one in the reverse direction.

Roughening of the aluminum plate surface was done under conditions that the rolls were revolved at 300 rpm and pressed against the aluminum plate by the elevator so that motor load became 2 kW.

The aluminum support thus prepared had a center-line average roughness of 0.55$\mu$ and it was treated by No. 3 sodium silicate solution in the same manner as in Support (I) to obtain Support (II) (Comparison 2).

(3) The aluminum web roughened according to the method of Comparison 1 was wound and then roughened by the brush graining according to the method of Comparison 2.

The support thus prepared had a center-line average roughness of 0.60$\mu$ and it was treated by No. 3 sodium silicate solution in the same manner as in Support (I) to obtain Support (III) (Example 1).

Supports (I), (II) and (III) thus prepared were coated with the following light-sensitive solution so as to result in a weight of 2.5 g/m$^2$after drying to obtain a light-sensitive layer.

| The light-sensitive solution | |
|---|---|
| Ester between naphthoquinone-1,2-diazido-5-sulfonylchloride and pyrogallol-acetone resin (disclosed in EXAMPLE 1 of U.S. Pat. No. 3,635,709) | 0.75 g |
| Novolak cresol | 2.00 g |
| Oil blue #603 (produced by ORIENT CHEMICAL Co.) | 0.04 g |
| Ethylene dichloride | 16 g |
| 2-Methoxyethyl acetate | 12 g |

The resulting presensitized plates were exposed to light of a 3 kW metal halide lamp at a distance of 1 m for 50 seconds through a positive transparency using a vacuum printing frame, developed with 5.26% aqueous sodium silicate solution ($SiO_2/Na_2O=1.74$, pH=12.7), washed with water and gummed up to obtain printing plates.

The printing plates were mounted on a printing machine, SPRINT 25 (produced by KOMORI PRINTING MACHINE Co.) and printing was conducted in a conventional manner. The results are shown in Table 1.

TABLE 1

| | Printing plate | | |
|---|---|---|---|
| | Support (III) EXAMPLE 1 | Support (I) COMPARISON 1 | Support (II) COMPARISON 2 |
| Printing durability (The number of clear copies) | 40,000 | 20,000 | 30,000 |
| Appearances (glossiness)* | 5.3 | 11.3 | 5.9 |
| Background contamination** | A | A | B |

*Glossiness: measured at a reflection angle of 60° using a glossmeter VG-10 produced by NIPPON DENSHOKU Co.
**Background contamination
A: insignificant from the practical point of view
B: significant from the practical point of view Table 1 shows that the printing plate using Support (III) of the present invention has higher printing durability and better appearance than the printing plate using Support (I) of COMPARISON 1, and higher printing durability and lower background contamination than the printing plate using Support (II) of COMPARISON 2.

EXAMPLE 2

According to the steps (1), (2) and (3) of EXAMPLE 1, an aluminum web was mechanically grained. Then, the web was washed with water and dipped in 10% aqueous sodium hydroxide solution at 70° C. to etch the aluminum surface in an amount of 6 g/m$^2$. It was then washed with water, dipped in 30% aqueous nitric acid for one minute and washed with water. Then it was anodized in 20% aqueous sulfuric acid using a direct current so as to form 1.5 g/m$^2$of anodic oxidation film, washed with water, dipped in 2% aqueous sodium silicate solution at 70° C. for one minute, washed with water and then dried.

The resulted supports (IV), (V) and (VI) were coated with the following light-sensitive solution so as to result in a weight of 2.0 g/m$^2$after drying to form a light-sensitive layer.

| | |
|---|---|
| The light-sensitive solution | 5.0 g |
| Copolymer of N—(4-hydroxyphenyl) methacrylamide, 2-hydroxyethyl methacrylate, acrylonitrile, methyl methacrylate and methacrylic acid (molar ratio = 15:10:30:38:7, average molecular weight = 60,000) | |
| Hexafluorophosphate of condensate of 4-diazodiphenylamine and formaldehyde | 0.5 g |
| Phosphorous acid | 0.05 g |
| Victoria pure blue BOH (produced by HODOGAYA KAGAKU Co.) | 0.1 g |
| 2-Methoxy ethanol | 100 g |

The resluted presensitized plates were image-wise exposed to light of a 3 kW metal halide lamp at a distance of 1 m for 50 seconds through a negative transparency using a vacuum printing frame, developed with the following developer and gummed up with aqueous gum arabic solution to obtain printing plates.

| The developer | |
|---|---|
| Sodium sulfite | 5 g |
| Benzyl alcohol | 30 g |
| Sodium carbonate | 5 g |
| Sodium isopropylnapthalenesulfonate | 12 g |
| Water | 1000 g |

Using the resulted printing plates, printing was conducted in a conventional manner. The results are shown in Table 2.

TABLE 2

| | Printing plate | | |
|---|---|---|---|
| | Support (VI) EXAMPLE 2 | Support (IV) COMPARISON 3 | Support (V) COMPARISON 4 |
| Printing durability (The number of clear copies) | 120,000 | 80,000 | 100,000 |
| Background contamination | A | A | B |

Table 2 shows that the printing plate using Support (VI) of the present invention has higher printing durability than the printing plate using COMPARISON Support (IV) or (V), and lower background contamination than the printing plate using COMPARISON Support (V).

EXAMPLE 3

Supports (I), (II) and (III) prepared in EXAMPLE 1 were washed with water, dipped in 30% aqueous sodium hydroxide at 60° C. to etch 6 g/m$^2$of aluminum, washed with water and dipped in 20% aqueous nitric acid to remove smut on the aluminum surface. It was then washed with water and electrochemically roughened in 0.7% aqueous nitric acid using alternating waved current as disclosed in U.S. Pat. No. 4,087,341 under conditions of 12.7 V of anodic voltage and 9.1 V of cathodic voltage such that the quantity of electricity at the anode time was 160 coulombs/dm$^2$. After smut on the aluminum surface was removed, Supports were anodized in 20% aqueous sulfuric acid to form 2 g/m$^2$of anodic oxidation film.

Supports (VII), (VIII) and (IX) thus prepared were coated with the same light-sensitive solution as used in EXAMPLE 1 so as to result in a weight of 2.5 g/m$^2$after drying to prepare presensitized plates, which were then image-wise exposed to light and developed to prepare printing plates. Using the printing plates thus prepared, printing was conducted in a conventional manner. The results are shown in Table 3.

TABLE 3

| | Printing plate | | |
|---|---|---|---|
| | Support (IX) EXAMPLE 3 | Support (VII) COMPARISON 5 | Support (VIII) COMPARISON 6 |
| Background contamination | A | B | B |
| Printing durability (The number of clear copies) | 130,000 | 100,000 | 120,000 |

Table 3 shows that the printing plate using Support (IX) has higher printing durability and lower background contamination than the printing plate using COMPARISON Support (VII) or (VIII).

EXAMPLE 4

Supports (VII), (VIII) and (IX) prepared by the same methods as in EXAMPLE 3 were washed with water, dipped in 2% aqueous sodium silicate at 70° C. for one minute, washed with water and dried to prepare Supports (X), (XI) and (XII), respectively. The supports were coated with the same light-sensitive solution as that used in EXAMPLE 2 so as to result in a weight of 2.0 g/m$^2$after drying, dried at 80° C. for 30 seconds, image-wise exposed and developed to prepare printing plates. Using the printing plates, printing was conducted in a conventional manner. Similar to the printing plate of Example 1 in which a positive working light-sensitive solution was used, sharp and clear copies were obtained and significant background contamination was not observed.

What is claimed is:

1. A process for producing an aluminum support for a lithographic printing plate, which comprises roughening an aluminum plate surface by a liquid honing process to form a first grain thereon and then modifying the first grain by a brush graining process.

2. The process of claim 1, wherein the liquid honing process comprises jetting a high-pressure liquid at a high flow rate from a nozzle, joining the stream of the high-pressure liquid with a slurry containing a fine powder of an abrasive, and directing the joined stream to strike against the surface of the aluminum plate.

3. The process of claim 2, further comprising a step of electrochemically graining the modified surface.

4. The process of claim 2, wherein the high-pressure liquid has a pressure of 5 to 100 kg/cm$^2$.

5. The process of claim 2, wherein the slurry is spouted through a nozzle at a flow rate of 2 to 25 m/sec.

6. The process of claim 2, wherein the slurry contains 5 to 80% by weight of the fine powder of the abrasive.

7. The process of claim 1, further comprising a step of electrochemically graining the modified surface.

8. The process of claim 7, wherein the modified surface is chemically etched prior to the electrochemical graining.

9. The process of claim 8, wherein the chemical etching is carried out at at temperature of from normal temperature to 90° C. for 5 seconds to 5 minutes with an etching solution having a concentration of 1 to 50% by weight of an etching agent until 0.1 to 10 g/m$^2$of aluminum is etched.

10. The process of claim 7, wherein the modified surface is alkali-etched prior to the electrochemical graining.

11. The process of claim 7, wherein an undercoat layer is provided on the modified and then electrochemically grained surface.

12. The process of claim 7, wherein the electrochemical graining is carried out by electrolysis in an electrolyte comprising a 0.1 to 10 wt.% hydrochloric acid or nitric acid solution or a mixture thereof using an alternating current.

13. The process of claim 1, wherein the brush graining is conducted so that the modified surface has a center-line average roughness (Ra) of from about 0.3 to about 1.2 μm.

14. The process of claim 1, wherein the modified surface is anodized to form an anodic oxidation film thereon in an amount of 0.1 to 10 g/m$^2$.

15. The process of claim 14, wherein an undercoat layer is provided on the anodic oxidation film.

16. The process of claim 14, wherein the undercoat layer is a silicate layer.

* * * * *